US005921060A

United States Patent [19]

Straeter

[11] Patent Number: 5,921,060

[45] Date of Patent: Jul. 13, 1999

[54] APPARATUS FOR COVERING AND BANDING A POT

[75] Inventor: Joseph G. Straeter, Highland, Ill.

[73] Assignee: Southpac Trust International, Inc.

[21] Appl. No.: 08/892,005

[22] Filed: Jul. 14, 1997

Related U.S. Application Data

[63] Continuation-in-part of application No. 08/646,476, May 7, 1996, abandoned.

[51] Int. Cl.[6] ..... B65B 11/00

[52] U.S. Cl. ..... 53/176; 53/585; 53/390

[58] Field of Search ..... 100/9; 53/397, 53/399, 465, 176, 580, 585, 218, 219, 220, 221, 390, 449

[56] References Cited

U.S. PATENT DOCUMENTS

| | | | |
|---|---|---|---|
| 1,520,647 | 12/1924 | Hennegan . | |
| 1,807,407 | 5/1931 | Hohnhorst . | |
| 1,868,853 | 7/1932 | Sievers . | |
| 2,068,144 | 1/1937 | McAleer | 53/221 |
| 2,152,648 | 4/1939 | Jones | 47/34 |
| 2,376,138 | 5/1945 | Harrison | 53/585 X |
| 3,360,901 | 1/1968 | Gallo | 53/390 |
| 3,531,910 | 10/1970 | Snead | 53/221 X |
| 3,962,503 | 6/1976 | Crawford | 428/40 |
| 3,974,762 | 8/1976 | Kita et al. | 53/585 X |
| 4,470,241 | 9/1984 | Parry et al. | 53/556 |
| 4,480,536 | 11/1984 | Burns | 53/390 X |
| 4,601,155 | 7/1986 | Lewis | 53/585 X |
| 4,733,521 | 3/1988 | Weder et al. | 53/580 |
| 4,795,601 | 1/1989 | Cheng | 264/138 |
| 4,980,209 | 12/1990 | Hill | 428/34.1 |
| 5,076,874 | 12/1991 | Weder | 156/212 |
| 5,077,937 | 1/1992 | Weder et al. | 47/72 |
| 5,105,599 | 4/1992 | Weder | 53/399 |
| 5,239,775 | 8/1993 | Landau | 47/72 |
| 5,291,721 | 3/1994 | Weder et al. | 53/580 |
| 5,339,601 | 8/1994 | Weder et al. | 53/397 |
| 5,410,856 | 5/1995 | Weder et al. | 53/397 |
| 5,417,033 | 5/1995 | Weder | 53/399 |
| 5,426,914 | 6/1995 | Weder et al. | 53/399 |
| 5,450,707 | 9/1995 | Weder et al. | 53/399 |
| 5,465,552 | 11/1995 | Weder et al. | 53/399 |
| 5,465,553 | 11/1995 | Weder et al. | 53/399 |
| 5,471,816 | 12/1995 | Weder et al. | 53/397 |

FOREIGN PATENT DOCUMENTS

| | | |
|---|---|---|
| 199995 | 12/1986 | European Pat. Off. . |
| 2619698 | 3/1989 | France . |
| 8905250 | 10/1989 | Germany . |
| 3162215 | 7/1991 | Japan . |
| 560532 | 4/1975 | Switzerland . |

*Primary Examiner*—Linda Johnson
*Attorney, Agent, or Firm*—Dunlap, Codding & Rogers, P.C.

[57] ABSTRACT

An apparatus for forming a sheet of material about a pot and applying a band therearound. The apparatus includes a table assembly, a pedestal, a plurality of spreader fingers, a plurality of release wedges and a plurality of linkage assemblies. The table assembly is provided with an opening and the pedestal is mounted for reciprocating movement through the opening. The sheet of material is formed into a cover about the pot by placing the sheet of material and pot on the pedestal and urging the pot through the opening. The spreader fingers are radially movable between a retracted position within the opening and an expanded position wherein the spreader fingers are positioned outside the perimeter of the opening. Each of the release wedges is located on the table assembly at the perimeter of the opening along the line of movement of a corresponding one of the spreader fingers. The linkage assemblies and the shape of the pedestal cooperate to move the spreader fingers in response to movement of the pedestal. With the fingers in the retracted position, a band is placed around the fingers. As the pedestal and pot are urged through the opening, the spreader fingers spread the band such that the band circumscribes the pot and cover. The release wedges then force the band off of the spreader fingers and onto the pot.

14 Claims, 8 Drawing Sheets

APPARATUS FOR COVERING AND BANDING A POT

CROSS-REFERENCE TO RELATED APPLICATIONS

This application is a continuation-in-part of U.S. Ser. No. 08/646,476, filed May 7, 1996, entitled APPARATUS AND METHOD FOR FORMING A SHEET OF MATERIAL ABOUT A POT AND PLACING A BAND THEREAROUND, now abandoned.

STATEMENT REGARDING FEDERALLY SPONSORED RESEARCH OR DEVELOPMENT

Not applicable.

BACKGROUND OF THE INVENTION

1. Field of the Invention

The present invention relates generally to devices for applying a band around an object, and more particularly, but not by way of limitation, to an apparatus for wrapping a sheet of material about a pot and applying a band around the pot to secure the sheet of material about the pot.

2. Description of Related Art

Various types of apparatus for forming covers about pots and attaching a fastener therearound are known in the art. For example, U.S. Pat. No. 5,450,707 issued to Weder et al. discloses an apparatus that cuts a sheet of material from a roll, forms the sheet about a pot, and conveys the pot to a tying machine where a band is tied around the pot and cover.

Further, U.S. Pat. Nos. 5,465,552 and 5,465,553 issued to Weder et al. disclose various types of rings, brackets, or band holders used to manually spread a band for application to a pot.

SUMMARY OF THE INVENTION

The present invention is directed to an apparatus for securing a sheet of material wrapped about a pot. The apparatus comprises a frame, a pedestal, a plurality of fingers for supporting an elastic band, and means for releasing the band from the fingers. The frame has a top support surface with a pot receiving opening formed therethrough. The pedestal has an upper support surface and is supported by the frame for reciprocating movement through the pot receiving opening between a first position wherein the pedestal supports the sheet of material and the pot above the pot receiving opening and a second position wherein the pedestal supports the pot with the sheet of material wrapped thereabout within the pot receiving opening. The fingers are radially spaced and slidably supported on the frame for radial movement between a retracted position wherein the fingers support an elastic band in a substantially unstretched condition and an expanded position wherein the fingers support the elastic band in a stretched condition sufficient to be disposed about the pot. The radially spaced fingers are mechanically linked to the pedestal so that the fingers move from the retracted position to the expanded position in response to movement of the pedestal from the first position to the second position. The releasing means allows the elastic band to be released from the fingers upon the fingers reaching the expanded position such that the stretched elastic band contracts about the sheet of material wrapped about the pot so as to secure the sheet of material to the pot.

The objects, features, and advantages of the present invention will become apparent from the following detailed description when read in conjunction with the accompanying drawings and appended claims.

DETAILED DESCRIPTION OF THE PREFERRED EMBODIMENTS

Figure 1:
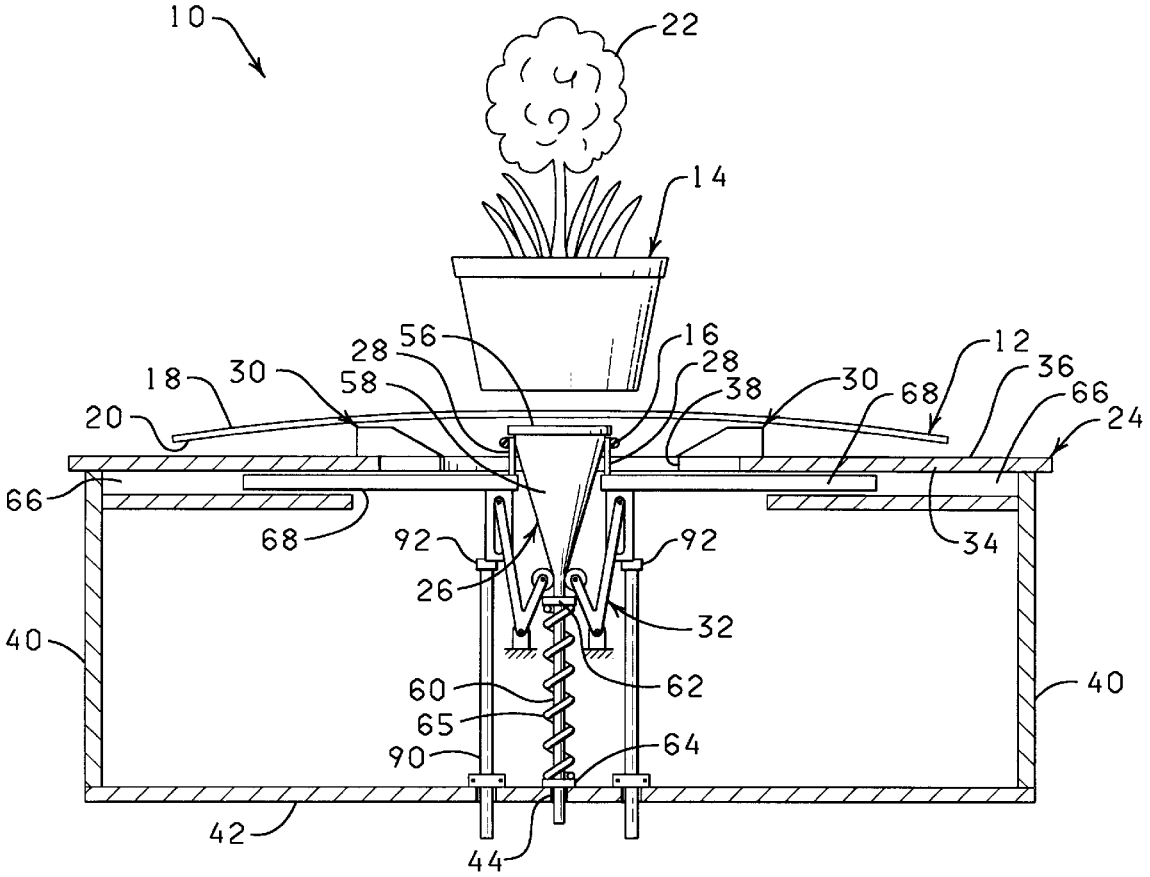
FIG. 1 is a partial, cross sectional view of an apparatus for wrapping and banding a pot constructed in accordance with the present invention shown readied to receive a pot with the banding assembly in a retracted position.

Referring to the drawings in general, and to FIG. 1 in particular, shown therein and designated by the general reference numeral 10 is an apparatus for forming a sheet of material 12 into a pot cover about a pot 14 and applying a band 16 around the pot 14 and pot cover.

The sheet of material 12 has an upper surface 18 and a lower surface 20 and is constructed from any suitable flexible material that is capable of being wrapped about the pot 14. Preferably, the sheet of material 12 is constructed of a material selected from a group of materials consisting of paper, metallic foil, cloth (natural or synthetic), denim, burlap or polymer film or combinations thereof.

The term "polymer film" as used herein means any polymer film. For example, but not by way of limitation, one polymer film is a polypropylene film. Another example of a polymer film, but not by way of limitation, is cellophane.

Typically, the sheet of material 12 has a thickness in a range from about 0.1 mils to about 30 mils. Preferably, the sheet of material 12 has a thickness in a range from about 0.1 mils to about 5 mils.

The sheet of material 12 may be constructed of a single layer of material or a plurality of layers of the same or different types of materials. Any thickness of the sheet of material may be utilized in accordance with the present invention so long as the sheet of material 12 is wrappable about the pot 14 as described herein. Additionally, an insulating material such as bubble film, preferably as one of two or more layers, can be utilized in order to provide additional protection for the pot 14 wrapped therein. The layers of material comprising the sheet of material 12 may be connected together or laminated or may be separate layers.

A decorative pattern, such as color and/or an embossed pattern, and/or other decorative surface ornamentation may be applied to the upper surface 18 and/or the lower surface 20 of the sheet of material 12 or portions thereof including, but not limited to printed design, coatings, colors, flocking or metallic finishes. The sheet of material also may be opaque, translucent, totally or partially clear or tinted transparent material.

The sheet of material also may be a cling wrap or cling material. The term "cling wrap or cling material" as used herein means any material which is capable of connecting to the sheet of material and/or itself upon contacting engagement during the wrapping process and is wrappable about the pot 14 whereby portions of the cling material contactingly engage and connect to other portions of the wrapping material for generally securing the sheet of material wrapped about at least a portion of the pot 14. This engagement is preferably temporary in that the wrapping material may be easily removed without tearing same, i.e., the cling material "clings" to the wrapping material.

The cling material is constructed from polyethylene. An example of a suitable cling material is Cling Wrap manufactured by Glad®, First Brands Corporation, located in Danbury, Conn. The thickness of the cling material will, in part, depend upon the thickness of the sheet of material utilized, i.e. generally the thicker and therefore heavier sheet of material may require a thicker and therefore stronger cling material. The cling material may range in thickness from about 0.2 mils to about 10 mils, and preferably is from about 0.5 mils to about 2.5 mils, and most preferably ranges from about 0.6 mils to about 2 mils. However, any thickness of cling material may be utilized in accordance with the present invention which permits the cling material to function as described herein.

Typically, the pot 14 is a flower pot containing a floral grouping 22. However, it should be appreciated that the pot 14 may be any kind of pot or any other object to be provided with an outer cover and/or a band.

The term "floral grouping" as used herein means cut fresh flowers, artificial flowers, a single flower, other fresh and/or artificial plants or other floral materials. The term "floral grouping" may also include other secondary plants and/or ornamentation which add to the aesthetics of the overall floral grouping.

The term "band" as used herein means any material which may be secured about an object such as a flower pot, such bands commonly being referred to as elastic bands or rubber bands and includes any elastic ring resembling a ribbon, strap, tape or string (with or without a bow or any other type of decoration or ornamentation). Further, the term "band" includes articles constructed of folded or coiled non-elastic materials, such as plastic or metal, shaped in a ring and having an internal bias for remaining folded or coiled. In other words, the term "band" includes any ring-like device with a bias for having a particular diameter and being spreadable to have a larger diameter.

With reference to FIGS. 1–4, the apparatus 10 includes a frame or table assembly 24, a pedestal 26, a plurality of spreader fingers 28, a plurality of release wedges 30, and a plurality of linkage assemblies 32 for moving the spreader fingers 28 in response to movement of the pedestal 26.

The table assembly 24 has an upper member 34 with an upper support surface 36. An opening 38, best shown in FIGS. 3 and 4, extends through the upper member 34 of the table assembly 24. The opening 38 is configured to receive the pot 14 whereby the upper member 34 forms the sheet of material 12 about the outer peripheral surface of the pot 14 as the pot 14 is moved down into the opening 38 in a manner to be discussed below.

It should be appreciated that the table assembly 24 is typically mounted on a base or legs (not shown) to position the upper support surface 36 at a height which is comfortable for the operator of the apparatus 10. The table assembly 24 has side members 40 and a lower member 42 which cooperate to support the upper member 34 of the table assembly 24 during operation of the apparatus 10. The lower member 42 has a slot 44 for guiding the movement of the pedestal 26 in a manner described in detail hereinbelow.

Figure 3:
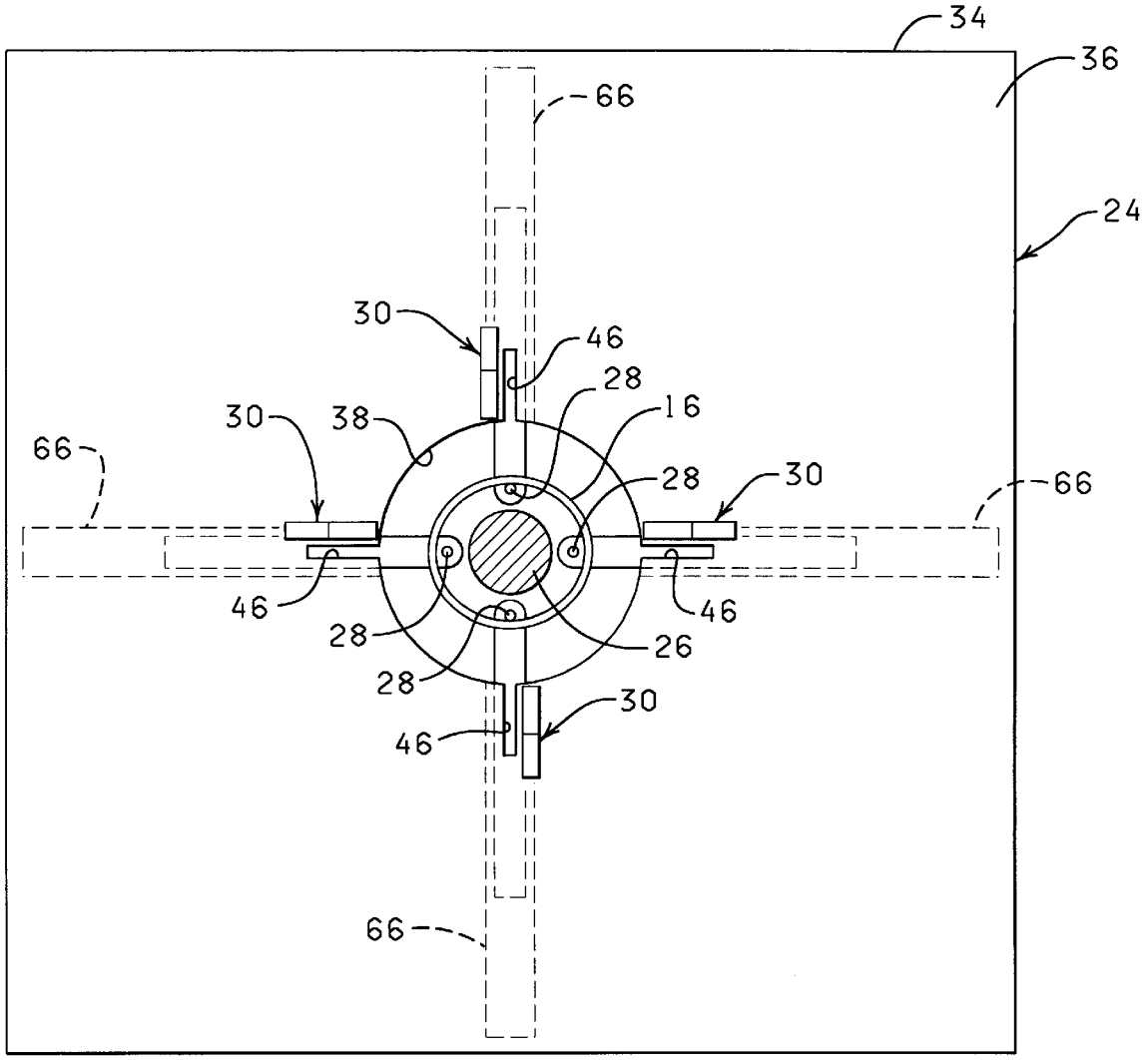
FIG. 3 is a fragmented, top plan view of the apparatus of FIG. 1.
Figure 4:
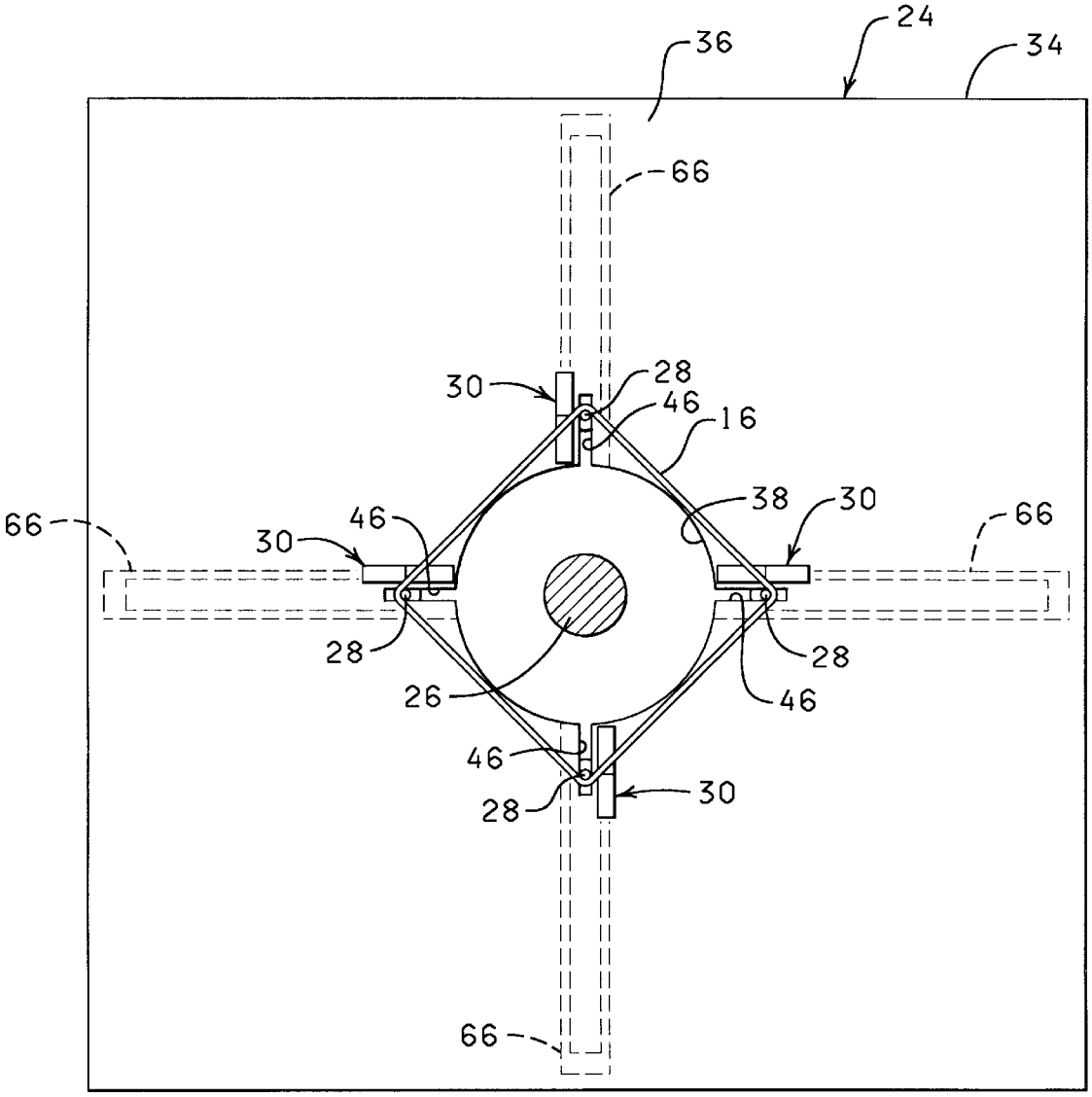
FIG. 4 is a fragmented, top plan view of the apparatus of FIG. 2.

With reference to FIG. 3, the upper member 34 of the table assembly 24 has a plurality of elongated slots 46 extending radially from the opening 38. Each of the slots 46 is sized, shaped and positioned such that a corresponding one of the spreader fingers 28 may travel from the opening 38 outward toward the end of the elongated slot 46, as illustrated in FIG. 4. It should be appreciated that the number and shapes of spreader fingers 28 and elongated slots 46 may be varied. However, at least three spaced points of contact with the band 16 are required to spread the band 16 for insertion of a lower portion of the pot 14 into the band 16.

Figure 7:
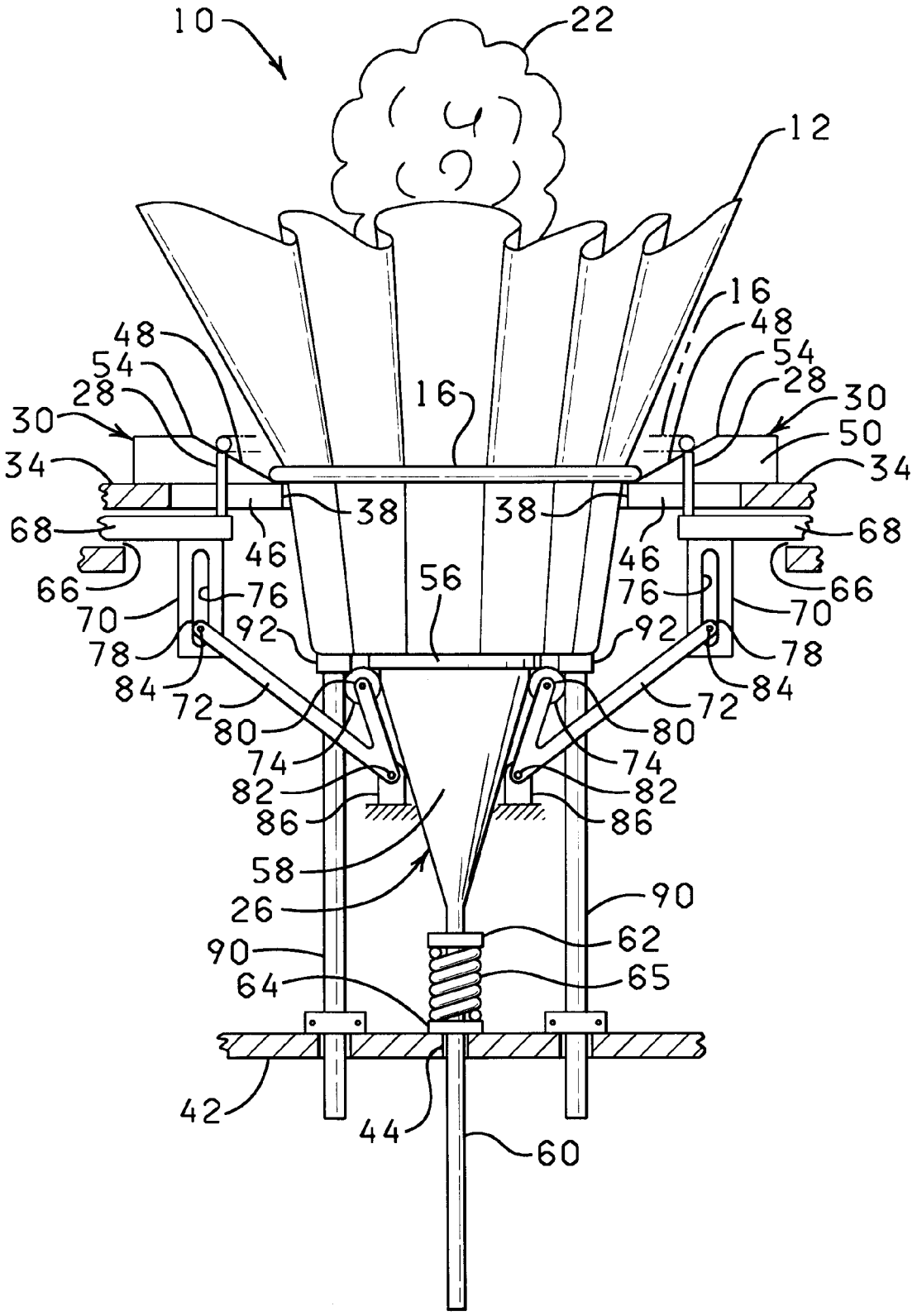
FIG. 7 is an enlarged, partial cross sectional view of the apparatus of the present invention showing the band applied to the pot.
Figure 8:
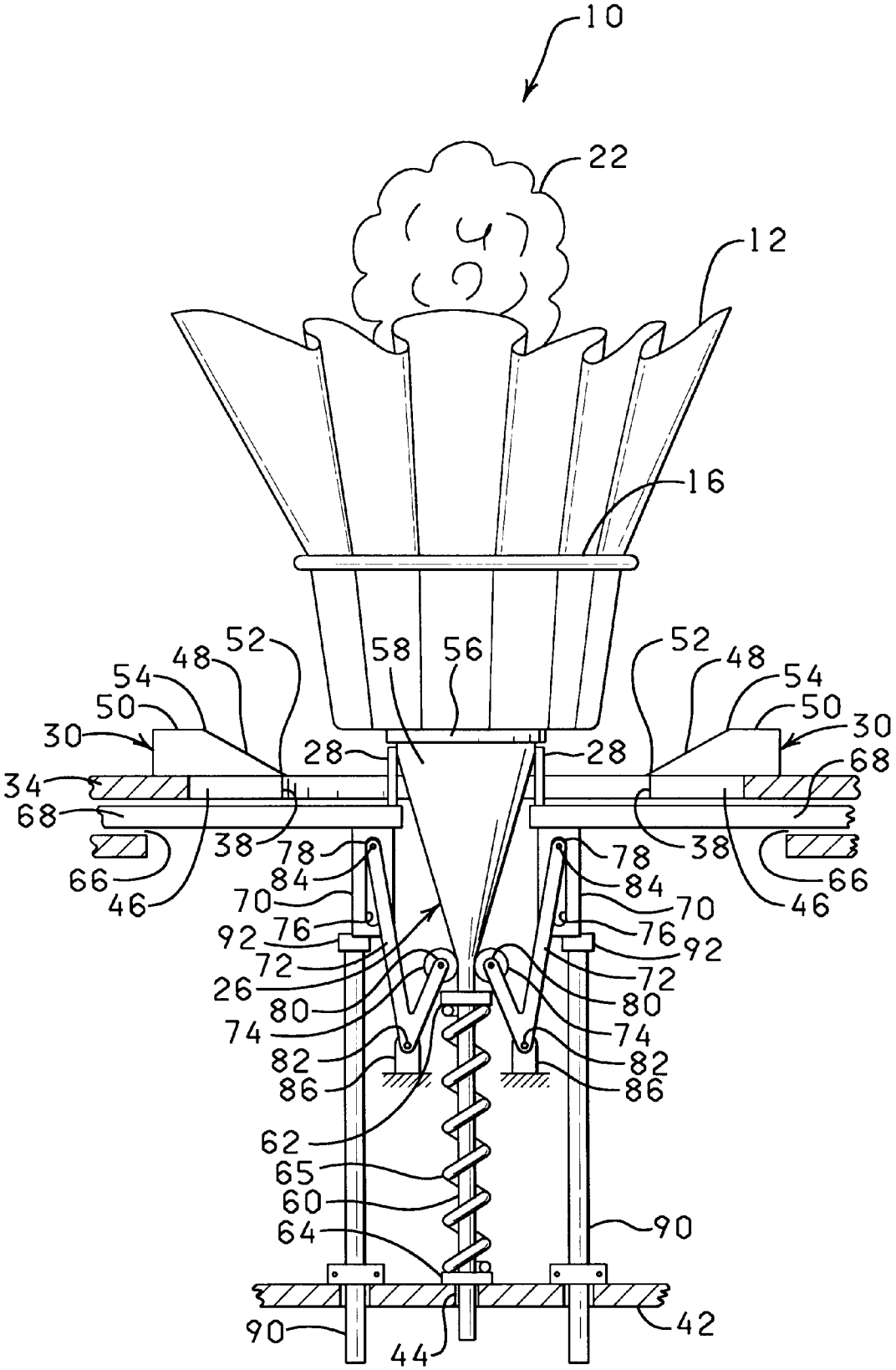
FIG. 8 is an enlarged, partial cross sectional view of the apparatus of the present invention showing the banded pot removed from the apparatus.

Each of the release wedges 30 is located adjacent a corresponding one of the elongated slots 46. As best shown in FIGS. 7 and 8, each of the release wedges 30 has a band engaging surface 48 and a block portion 50. The band engaging surface 48 of each release wedge 30 has a low end 52 proximate to the opening 38 and a high end 54 distal from the opening 38. Thus, the band engaging surface 48 of each release wedge 30 slopes upward away from the opening 38.

It should be appreciated that the release wedges 30 may be constructed in a wide variety of shapes consistent with their purpose and function as disclosed herein. For example, the overall shape of the release wedges 30 may be triangular or any other shape having a sloping or ramp-like portion. It should also be appreciated that the number of release wedges 30 may be varied. For example, the release wedges 30 may be positioned on both sides of each one of the slots 46 rather than on only one side.

The high end 54 of the band engaging surface 48 of each release wedge 30 should have a height of at least the height of the corresponding spreader finger 28. Further, the height of the block portion 50 of each release wedge 30 is typically about equal to the height of the spreader fingers 28. Alternatively, the height of the high end 54 of the band engaging surface 48 of each release wedge 30 may exceed the height of the corresponding spreader finger 28 or may change in shape or slope in any manner consistent with its purpose and function as disclosed herein.

Referring again to FIGS. 1 and 2, the pedestal 26 includes an upper pedestal disc 56, an intermediate pedestal cone 58 and a lower pedestal rod 60. The pedestal disc 56 has a support surface for supporting the pot 14 with the sheet of material 12 disposed between the bottom of the pot 14 and the pedestal disc 56. The pedestal rod 60 extends through the slot 44 in the lower member 42 of the table assembly 24. As the pedestal 26 is moved upward or downward, the pedestal rod 60 travels through the slot 44 to keep the pedestal 26 aligned with the opening 38.

Figure 2:
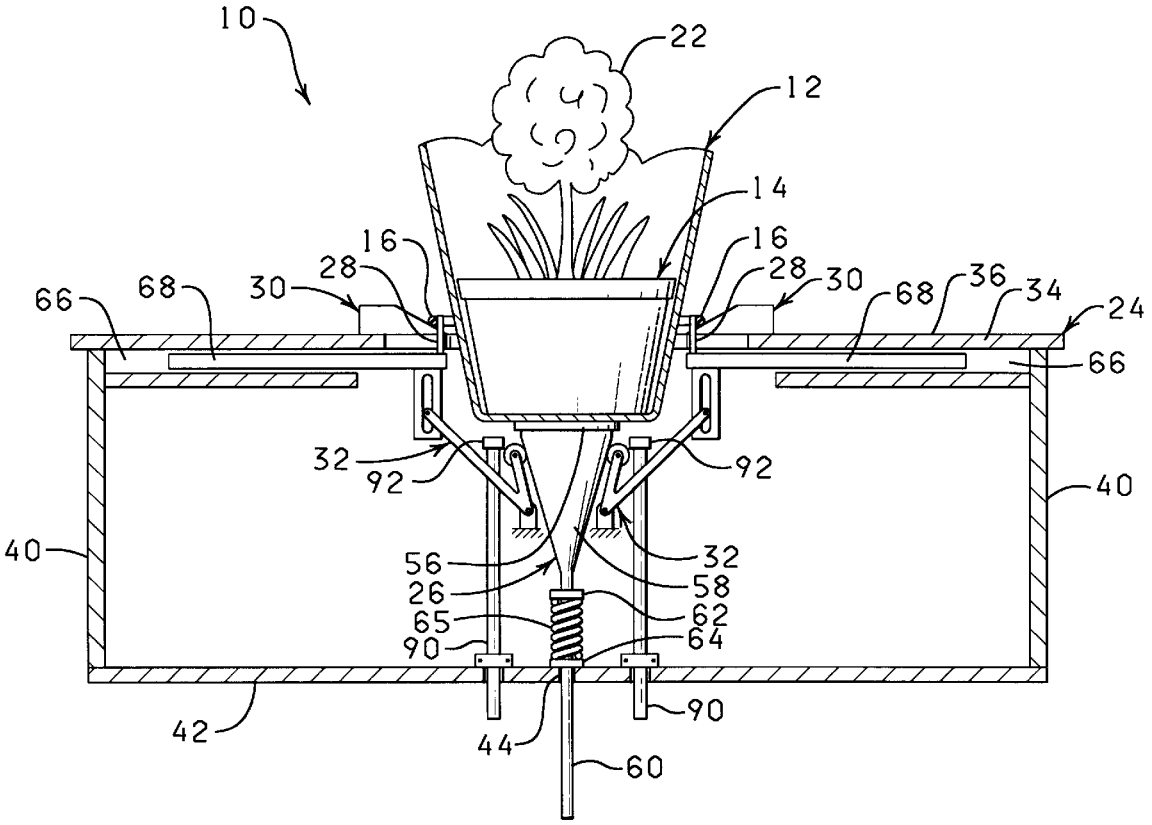
FIG. 2 is a partially cross sectional view of the apparatus of the present invention showing the pot having been received in the apparatus and the banding assembly in an expanded position.
Figure 5:
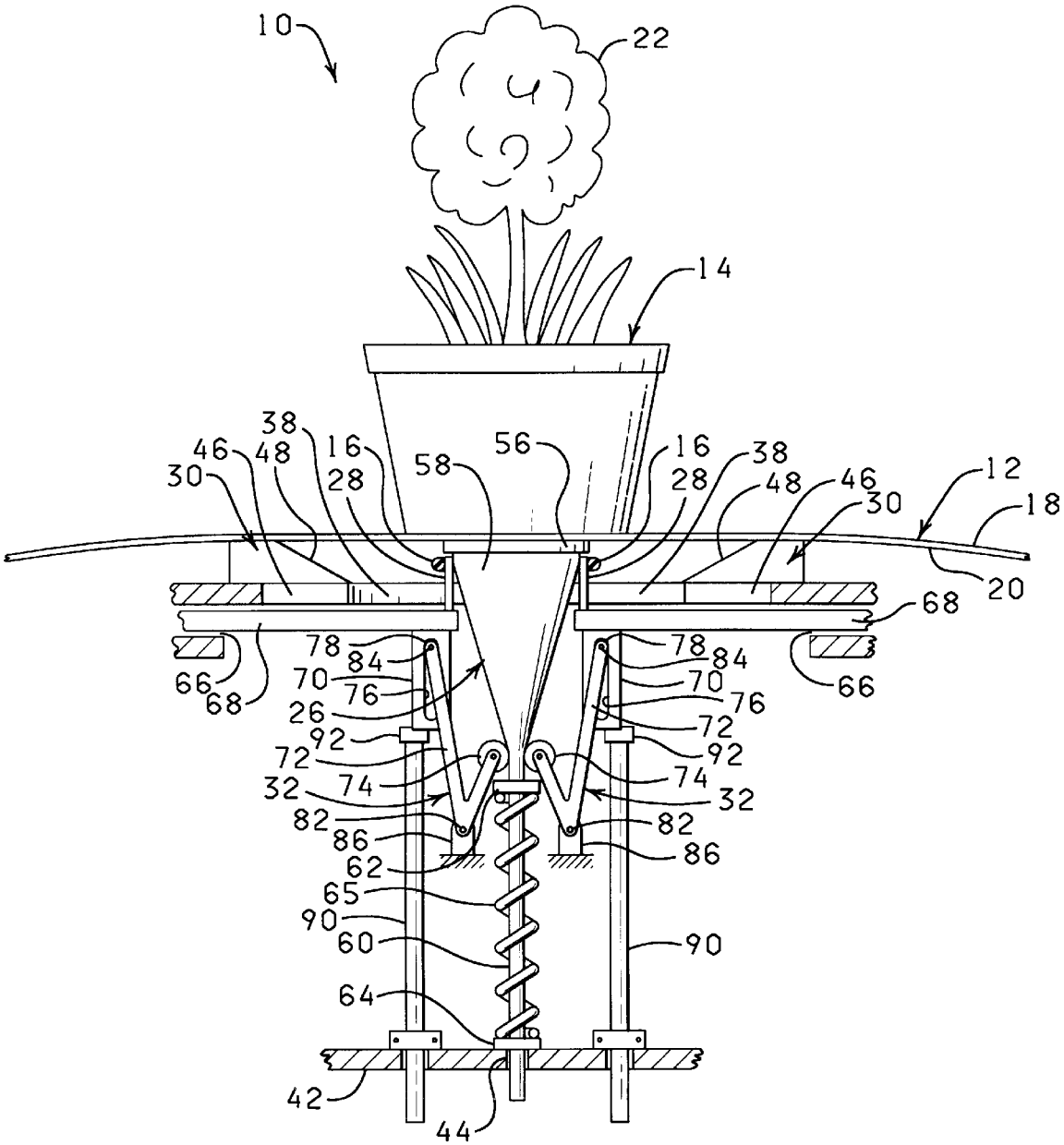
FIG. 5 is an enlarged, partial cross sectional view of the apparatus showing a sheet of material and a pot disposed thereon.
Figure 6:
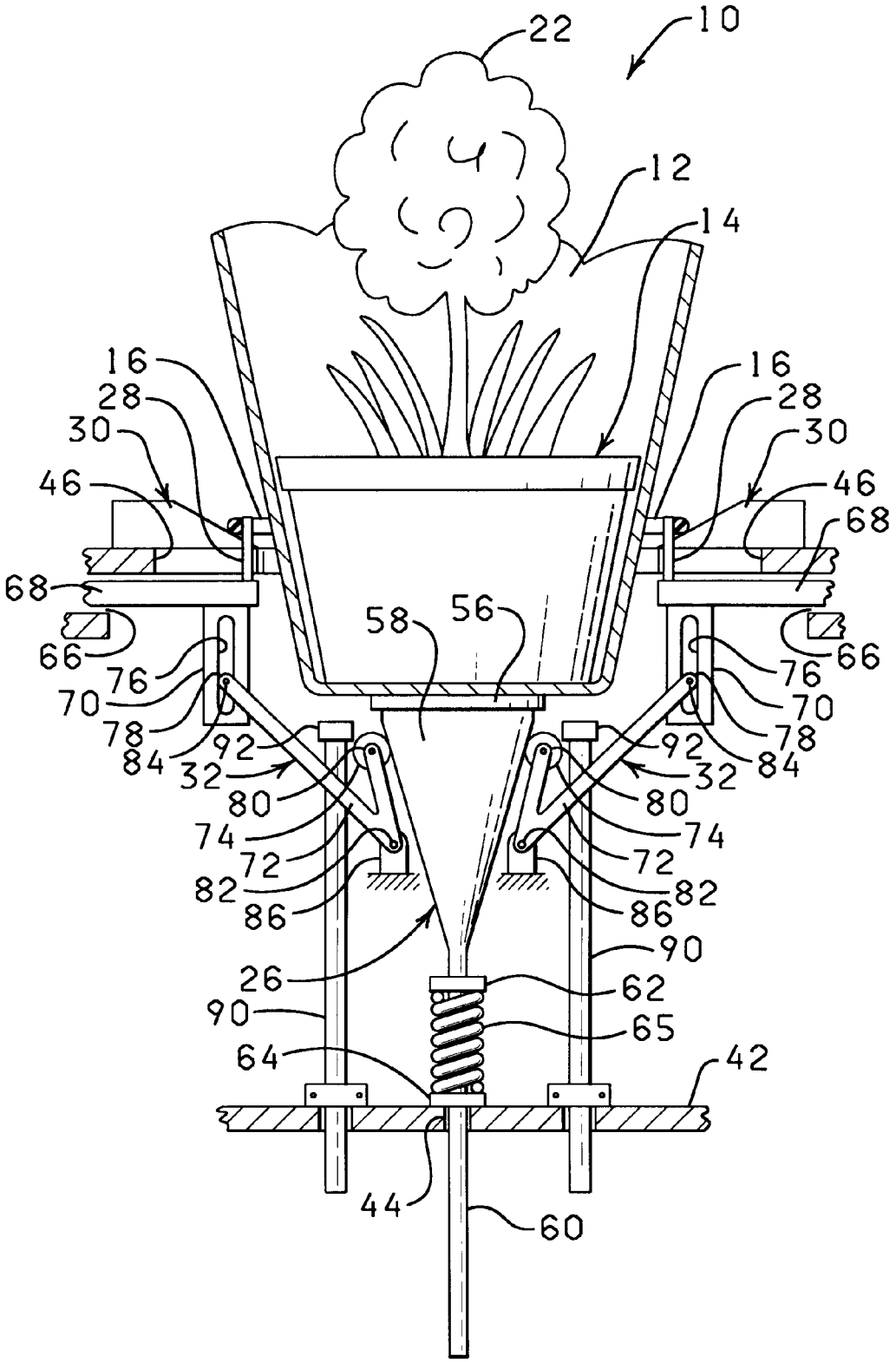
FIG. 6 is an enlarged, partial cross sectional view of the apparatus showing the sheet of material and the pot received in the apparatus.

The pedestal 26 is mounted to the table assembly 24 for reciprocating movement through the opening 38. Thus, the pedestal 26 is movable between a first or staging position (FIGS. 1 and 5) and a second or completion position (FIGS. 2 and 6). To bias the pedestal 26 into the first position, an upper collar 62 is provided on the pedestal rod 60, which is journaled through a lower bushing 64, and a biasing spring 65 is journaled onto the pedestal rod 60 between the collar 62 and the bushing 64. With this construction, the biasing spring 65 urges the pedestal 26 into the first position, as illustrated in FIGS. 1 and 5. As such, it is necessary to force the pedestal 26 downward, compressing the biasing spring 65, to place the pedestal 26 in the second position, shown in FIGS. 2 and 6.

The pedestal 26 may be constructed in a variety of shapes consistent with its function as disclosed herein. For example, the pedestal cone 58 may be pyramidal or multi-faceted instead of conical in shape. Moreover, the pedestal disc 56 may have any shape which is suitable for supporting the pot 14 and cover and which is consistent with construction and operation of the apparatus 10 as disclosed herein.

With reference to FIGS. 1–4, the table assembly 24 is provided with a plurality of slide channels 66. Each of the slide channels 66 extends radially from the opening 38 at the underside of the upper member 34 of the table assembly 24.

The apparatus 10 further includes a plurality of slide members 68, which carry the spreader fingers 28. Each of the slide members 68 is disposed within a corresponding one of the slide channels 66 for reciprocating movement through the corresponding slide channel 66.

A corresponding one of the spreader fingers 28 is mounted to the inner end of each of the slide members 68. The spreader fingers 28 are dimensioned to extend above the upper support surface 36 of the table assembly 24. The slide members 68 carry the spreader fingers 28 radially into the opening 38 (FIG. 3) and radially out from the opening 38 into a corresponding one of the elongated slots 46 (FIG. 4). In this manner, the spreader fingers 28 are movable between a retracted position wherein each of the spreader fingers 28 is positioned in a central area of the opening 38 (FIG. 3) so as to support the band 16 in a substantially unstretched condition and an expanded position wherein each of the spreader fingers 28 is disposed in one of the elongated slots 46 at a point spaced a distance from the opening 38 (FIG. 4) so as to support the band 16 in a stretched condition so as to be disposable about the pot.

The slide members 68 may travel within the slide channels 66 of the table assembly 24 in a wide variety of ways. For example, the slide members 68 may merely slide within the slide channels 66 or may roll on any suitable type of wheels, rollers, rails, casters or bearings. Further, the slide members 68 and slide channels 66 may be provided with any conventional slide mechanisms commonly used in the sliding drawers of bureaus, desks, cabinets and the like.

As best illustrated in FIGS. 5 and 6, the linkage assemblies 32 mechanically link the spreader fingers 28 to the pedestal 26 so that the fingers 28 move from the retracted position (FIG. 5) to the expanded position (FIG. 6) in response to movement of the pedestal from the first position (FIG. 5) to the second position (FIG. 6). Each of the linkage assemblies 32 includes a bracket 70, a pivot arm 72, and a roller 74. The bracket 70 extends downward from the inner end of a corresponding slide member 68. The bracket 70 is provided with an elongated vertical slot 76.

The pivot arm 72 is a substantially L-shaped member having a first end 78, a second end 80, and a pivot point 82. The first end 78 of the pivot arm 72 is provided with a laterally extending slide pin 84 which is slidably disposed in the slot 76 of the bracket 70. The roller 74 is rollingly connected to the second end 80 of the pivot arm 72, and the pivot arm 72 is pivotally connected to a support frame 86 at the pivot point 82 so that the roller 74 is rollingly engaged with a lower portion of the pedestal cone 58 when the pedestal 26 is in the first position and so that the slide pin 84 is positioned in an upper portion of the vertical slot 76 of the bracket 70 with the fingers 28 in the retracted position. Accordingly, when the pedestal 26 is moved downward into the second position, the conical shape of the pedestal cone 58 causes the roller 74 to travel up the pedestal cone 58 thereby causing the pivot arm 72 to rotate away from the pedestal 26. Rotation of the pivot arm 72 in this manner in turn causes the slide pin 84 to engage the bracket 70 and move the bracket 70, along with the slide member 68 and the finger 28, in an outward radial direction to the expanded position.

It will be appreciated that numerous variations with respect to the configuration of the linkage assemblies 32 may be used. For example, the pivot arms 72 could be constructed to slide within a track or channel formed along the pedestal cone 58 so that the pivot arm 72 rotates away from the pedestal 26 as the pedestal 26 is moved from the first position to the second position and rotates toward the pedestal 26 as the pedestal is moved from the second position to the first position. It will further be appreciated that in the use of the rollers 74, as described above, the fingers 28 can be biased in the retracted position so that the fingers 28 return to the retracted position upon completion of wrapping and banding the pot 14. This can be accomplished by using a spring (not shown) positioned between the outer end of the slide members 68 and the side members 40 of the table assembly 24 or any other suitable device for biasing the fingers 28 in the retracted position.

One or more stop members 90 may be mounted to the table assembly 24 to limit the downward movement of the pot 14. As illustrated by FIGS. 2 and 6, the stop members 90 are located to engage the bottom of the pot 14 when the pot 14 reaches a selected downwardmost position. The stop members 90 may be any shape which will engage the bottom of the pot 14 without interfering with the movement of the pedestal 26 and the linkage assembly 32. The stop members 90 may be mounted to the table assembly 24 in a manner which allows adjustment of their position. In this way, the point of engagement of the stop members 90 with the bottom of the pot 14 may be selectable.

A pad, cushion or bumper 92 may be provided at the upper end of each one of the stop members 90. With this construction, the pads, cushions or bumpers 92 engage the sheet of material 12 and keep the upper ends of the stop members 90 from damaging the sheet of material 12.

Operation

In one manner of use, the apparatus 10 is utilized both to form a sheet of material 12 into a cover about a pot 14 and to apply the band 16 therearound.

Initially, as shown in FIG. 1, the spring 65 biases the pedestal 26 into the first position with the pedestal disc 56 extending upwardly through the opening 38. The spreader fingers 28 are in the retracted position just below the pedestal disc 56. With the pedestal 26 in the first position and the spreader fingers 28 in the retracted position, the band 16 is placed over the pedestal disc 56 and around the spreader fingers 28 (FIGS. 1, 3 and 5). Next, the sheet of material 12 is disposed on the upper support surface 36 of the table assembly 24 over the opening 38. The pot 14 is then set on the sheet of material 12 directly over the pedestal 26 such that the pedestal disc 56 supports the pot 14 with the sheet of material 12 disposed between the pedestal disc 56 and the pot 14.

The pot 14 is then pushed downward to overcome the bias of the spring 65. As the pot 14 urges the pedestal 26 downward, a portion of the sheet of material 12 is forced through the opening 38 so as to form the sheet of material 12 into a cover about the pot 14.

Simultaneously, the pedestal cone 58 urges the rollers 74 in an outward direction thereby causing the pivot arms 72 to rotate outwardly, whereby the slide pins 84 force the brackets 70 radially outward. This action forces the slide members 68 and spreader fingers 28 to the expanded position wherein the band 16 is supported in a stretched condition so as to be disposable about the pot 14 (FIGS. 4 and 6).

As the fingers 28 are moved toward the expanded position, the band 16 engages the band engaging surface 48 of the wedges 30 and the band 16 is urged upward on the spreader fingers 28 as the spreader fingers 28 move outward. When the fingers 28 are in the expanded position, the sheet of material 12 has formed into a cover about the pot 14 and the release wedges 30 urge the band 16 off of the upper ends of the spreader fingers 28 (FIG. 7). The elasticity or internal bias of the band 16 causes the band 16 to contract about the pot 14 and cover, as shown in FIG. 7.

With the band 16 in place about the pot 14 and cover, the downward pressure on the pot 14 is reduced and the bias of the spring 65 returns the pedestal 26 to the first position, as shown in FIG. 8. The pot 14, with the cover and band 16 applied thereto, is then removed from the pedestal disc 56 and the apparatus 10 is readied for another use.

It will be appreciated that the apparatus 10 may be used to form more than one cover on a pot by disposing more than one sheet of material between the pot and the pedestal 26. Further, the apparatus may be utilized to form a second outer cover on a pot already having a first outer cover on it. Additionally, the apparatus 10 may be used to band a pot with a cover already disposed about the pot 14 or to band a pot without a cover at all or to form one or more covers on a pot without applying a band.

Changes may be made in the combinations, operations and arrangements of the various parts and elements described herein without departing from the spirit and scope of the invention as defined in the following claims.

What is claimed is:

1. An apparatus for applying an elastic band about a pot, the apparatus comprising:

a frame having a pot receiving opening;

a pedestal having an upper support surface, the pedestal supported by the frame for reciprocating movement through the pot receiving opening between a first position wherein the pedestal supports the pot above the pot receiving opening and a second position wherein the pedestal supports the pot within the pot receiving opening;

a plurality of radially spaced fingers slidably supported on the frame about the pot receiving opening of the frame for radial movement between a retracted position wherein the fingers are adapted to support the elastic band in a substantially unstretched condition and an expanded position wherein the fingers are adapted to support the elastic band in a stretched condition so that the pot can be disposed through the elastic band, the radially spaced fingers linked to the pedestal so that the fingers move from the retracted position to the expanded position in response to movement of the pedestal from the first position to the second position; and means for releasing the elastic band from the fingers with the fingers in the expanded position so that the stretched elastic band is able to contract about the pot.

2. The apparatus of claim 1 further comprising:

means for biasing the pedestal in the first position.

3. The apparatus of claim 1 wherein the pedestal has a substantially conical portion with an increasing diameter from the lower end to the upper end thereof, wherein each of the fingers is mounted to a slide member slidably mounted to the frame, and wherein each of the slide members is linked to the conical portion of the pedestal by a linkage assembly, each linkage assembly comprising:

a bracket connected to the slide member; and a pivot arm pivotally connected to the frame and having one end slidingly engageable with the bracket and another end rollingly engageable with the conical portion of the pedestal so that as the pedestal moves from the first position to the second position the pivot arm is caused to rotate in a direction away from the pedestal in turn forcing the bracket together with the slide member and the finger to move in an outward radial direction to the expanded position.

4. An apparatus for wrapping a sheet of material about at least a portion of a pot and applying an elastic band about the sheet of material to secure the sheet of material to the pot, the apparatus comprising:

a frame having a top support surface with a pot receiving opening formed therethrough, the pot receiving opening configured so that when the lower end of the pot is positioned on a portion of the sheet of material with the sheet of material positioned over the pot receiving opening the sheet of material is forced about the outer peripheral surface of the pot as the pot is moved into the pot receiving opening;

a pedestal having an upper support surface, the pedestal supported by the frame for reciprocating movement through the pot receiving opening between a first position wherein the pedestal supports the sheet of material and the pot above the pot receiving opening and a second position wherein the pedestal supports the pot with the sheet of material wrapped thereabout within the pot receiving opening;

a plurality of radially spaced fingers slidably supported on the frame about the pot receiving opening for radial movement between a retracted position wherein the fingers are adapted to support the elastic band in a substantially unstretched condition and an expanded position wherein the fingers are adapted to support the elastic band in a stretched condition so that the sheet of material and the pot can be disposed through the elastic band;

means for linking the radially spaced fingers to the pedestal so that the fingers move from the retracted position to the expanded position in response to movement of the pedestal from the first position to the second position; and means for releasing the elastic band from the fingers with the fingers in the expanded position so that the stretched elastic band is able to contract about the sheet of material wrapped about the pot so as to secure the sheet of material about the pot.

5. The apparatus of claim 4 further comprising:

means for biasing the pedestal in the first position.

6. The apparatus of claim 4 wherein the pedestal has a substantially conical portion with an increasing diameter from the lower end to the upper end thereof, wherein each of the fingers is mounted to a slide member slidably mounted to the frame, and wherein the link means comprises a plurality of linkage assemblies for linking a corresponding one of the fingers to the pedestal, each of the linkage assemblies comprising:

a bracket connected to the slide member; and a pivot arm pivotally connected to the frame and having one end slidingly engageable with the bracket and another end rollingly engageable with the conical portion of the pedestal so that as the pedestal moves from the first position to the second position the pivot arm is caused to rotate in a direction away from the pedestal in turn forcing the bracket together with the slide member and the finger to move in an outward radial direction to the expanded position.

7. An apparatus for applying an elastic band about a pot, the apparatus comprising:

a frame having a pot receiving opening;

a pedestal having an upper support surface, the pedestal supported by the frame for reciprocating movement through the pot receiving opening between a first position wherein the pedestal supports the pot above the pot receiving opening and a second position wherein the pedestal supports the pot within the pot receiving opening;

a plurality of radially spaced fingers slidably supported on the frame about the pot receiving opening for radial movement between a retracted position wherein the fingers are adapted to support the elastic band in a substantially unstretched condition and an expanded position wherein the fingers are adapted to support the elastic band in a stretched condition so that the pot can be disposed through the elastic band;

means for linking the radially spaced fingers to the pedestal so that the fingers move from the retracted position to the expanded position in response to movement of the pedestal from the first position to the second position; and a plurality of wedges mounted to the frame about the pot receiving opening, each of the wedges having an upwardly sloped band engaging surface positioned to engage the elastic band as the fingers are moved to the expanded position so as to urge the band off of the corresponding finger when the fingers are in the expanded position, thereby allowing the stretched elastic band to contract about the pot.

8. The apparatus of claim 7 further comprising:

means for biasing the pedestal in the first position.

9. The apparatus of claim 7 wherein the pedestal has a substantially conical portion with an increasing diameter from the lower end to the upper end thereof, wherein each of the fingers is mounted to a slide member slidably mounted to the frame, and wherein the link means comprises a plurality of linkage assemblies for linking a corresponding one of the fingers to the pedestal, each of the linkage assemblies comprising:

a bracket connected to the slide member; and a pivot arm pivotally connected to the frame and having one end slidingly engageable with the bracket and another end rollingly engageable with the conical portion of the pedestal so that as the pedestal moves from the first position to the second position the pivot arm is caused to rotate in a direction away from the pedestal in turn forcing the bracket together with the slide member and the finger to move in an outward radial direction to the expanded position.

10. An apparatus for wrapping a sheet of material about at least a portion of a pot and applying an elastic band about the sheet of material to secure the sheet of material to the pot, the apparatus comprising:

a frame having a top support surface with a pot receiving opening formed therethrough, the pot receiving opening configured so that when the lower end of the pot is positioned on a portion of the sheet of material with the sheet of material positioned over the pot receiving opening the sheet of material is forced about the outer peripheral surface of the pot as the pot is moved into the pot receiving opening;

a pedestal having an upper support surface, the pedestal supported by the frame for reciprocating movement through the pot receiving opening between a first position wherein the pedestal supports the sheet of material and the pot above the pot receiving opening and a second position wherein the pedestal supports the pot with the sheet of material wrapped thereabout within the pot receiving opening;

a plurality of radially spaced fingers slidably supported on the frame about the pot receiving opening for radial movement between a retracted position wherein the fingers are adapted to support the elastic band in a substantially unstretched condition and an expanded position wherein the fingers are adapted to support the elastic band in a stretched condition so that the sheet of material and the pot can be disposed through the elastic band;

means for linking the radially spaced fingers to the pedestal so that the fingers move from the retracted position to the expanded position in response to movement of the pedestal from the first position to the second position; and a plurality of wedges mounted to the frame about the pot receiving opening, each of the wedges having an upwardly sloped band engaging surface positioned to engage the elastic band as the fingers are moved to the expanded position so as to urge the band off of the corresponding finger when the fingers are in the expanded position, thereby allowing the stretched elastic band to contract about the sheet of material wrapped about the pot so as to secure the sheet of material about the pot.

11. The apparatus of claim 10 further comprising:

means for biasing the pedestal in the first position.

12. The apparatus of claim 10 wherein the pedestal has a substantially conical portion with an increasing diameter from the lower end to the upper end thereof, wherein each of the fingers is mounted to a slide member slidably mounted to the frame, and wherein the link means comprises a plurality of linkage assemblies for linking a corresponding one of the fingers to the pedestal, each of the linkage assemblies comprising:

a bracket connected to the slide member; and a pivot arm pivotally connected to the frame and having one end slidingly engageable with the bracket and another end rollingly engageable with the conical portion of the pedestal so that as the pedestal moves from the first position to the second position the pivot arm is caused to rotate in a direction away from the pedestal in turn forcing the bracket together with the slide member and the finger to move in an outward radial direction to the expanded position.

13. A banding apparatus, comprising:

a pedestal movable between a first position and a second position;

a plurality of radially spaced fingers linked to the pedestal so that the fingers move radially from a retracted position wherein the fingers are adapted to support an elastic band in a substantially unstretched condition to an expanded position wherein the fingers are adapted to support the elastic band in a stretched condition so that an object can be disposed through the elastic band in response to movement of the pedestal from the first position to the second position; and means for releasing the elastic band from the fingers with the fingers in the expanded position so that the stretched elastic band is permitted to contract about the object.

14. A banding apparatus, comprising:

a pedestal movable between a first position and a second position;

a plurality of radially spaced fingers linked to the pedestal so that the fingers move radially from a retracted position wherein the fingers are adapted to support an elastic band in a substantially unstretched condition to an expanded position wherein the fingers are adapted to support the elastic band in a stretched condition so that an object can be disposed through the elastic band in response to movement of the pedestal from the first position to the second position; and a plurality of wedges, each having an upwardly sloped band engaging surface positioned to engage the elastic band as the fingers are moved to the expanded position so as to urge the band off of the corresponding finger when the fingers are in the expanded position, thereby permitting the stretched elastic band to contract about the pot.

* * * * *

UNITED STATES PATENT AND TRADEMARK OFFICE

CERTIFICATE OF CORRECTION

PATENT NO. : 5,921,060

DATED : July 13, 1999

INVENTOR(S) : Joseph G. STRAETER

It is certified that error appears in the above-identified patent and that said Letters Patent is hereby corrected as shown below:

Fig. 3, insert the numeral --68-- (four occurrences) and its associated lead line.

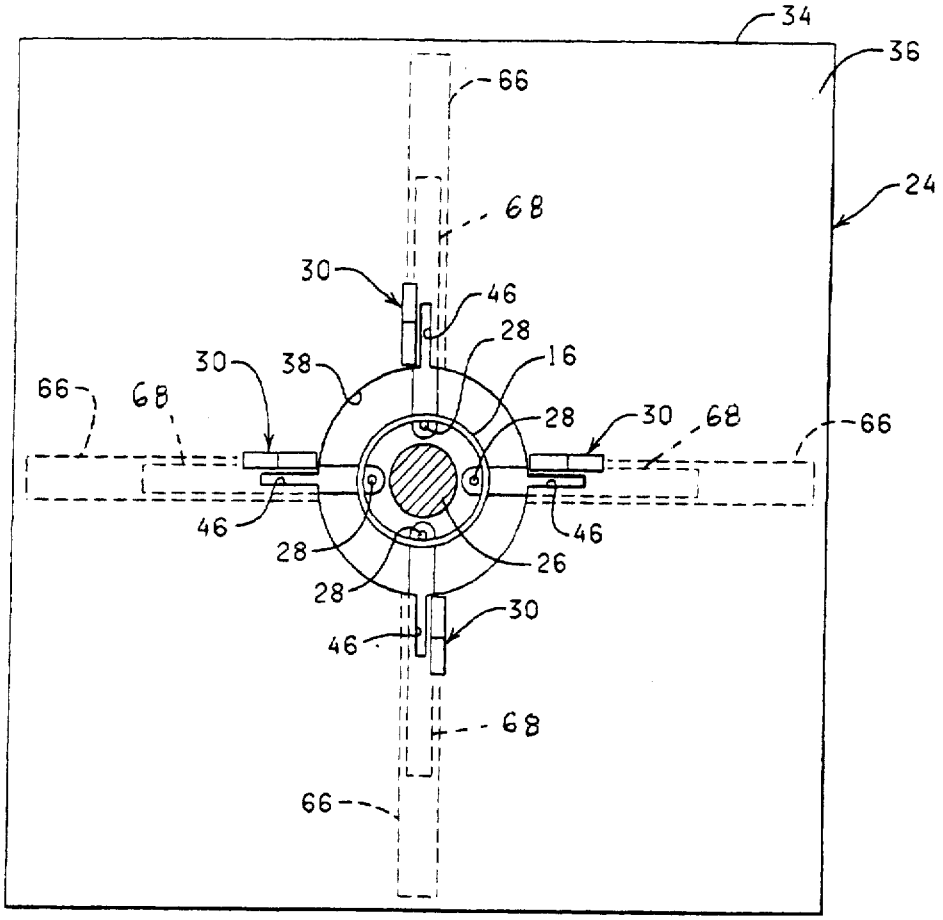

FIG. 3

UNITED STATES PATENT AND TRADEMARK OFFICE

CERTIFICATE OF CORRECTION

PATENT NO. : 5,921,060

DATED : July 13, 1999

INVENTOR(S) : Joseph G. STRAETER

It is certified that error appears in the above-identified patent and that said Letters Patent is hereby corrected as shown below:

Fig. 4, insert the numeral --68-- (four occurrences) and its associated lead line.

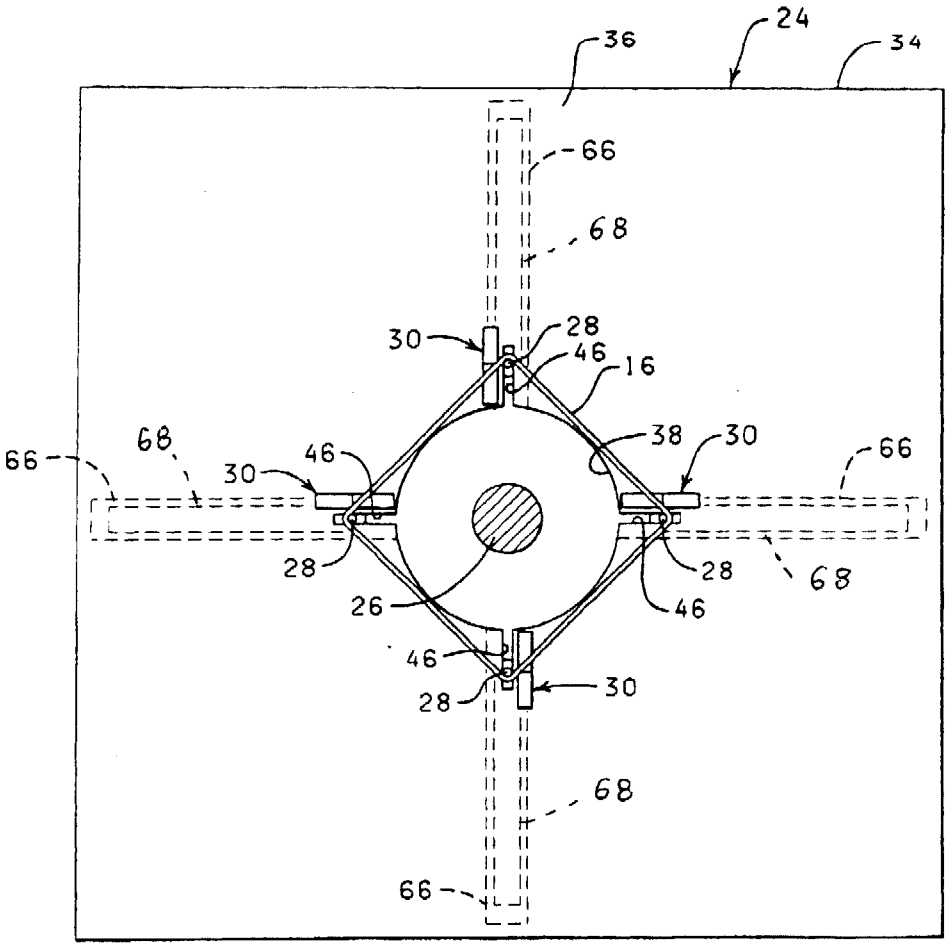

FIG. 4

UNITED STATES PATENT AND TRADEMARK OFFICE

CERTIFICATE OF CORRECTION

PATENT NO. : 5,921,060

DATED : July 13, 1999

INVENTOR(S) : Joseph G. STRAETER

It is certified that error appears in the above-identified patent and that said Letters Patent is hereby corrected as shown below:

Col. 3: line 5, delete "design," and substitute --designs,-- therefor;

Signed and Sealed this

Twenty-second Day of May, 2001

*Attest:*

Nicholas P. Godici

NICHOLAS P. GODICI

*Attesting Officer*

*Acting Director of the United States Patent and Trademark Office*